US010852685B2

(12) United States Patent
Kishi et al.

(10) Patent No.: US 10,852,685 B2
(45) Date of Patent: Dec. 1, 2020

(54) DRUM CARTRIDGE AND IMAGE FORMING APPARATUS

(71) Applicant: BROTHER KOGYO KABUSHIKI KAISHA, Nagoya-shi, Aichi-ken (JP)

(72) Inventors: Isao Kishi, Nagoya (JP); Yuwen Wang, Nagoya (JP)

(73) Assignee: BROTHER KOGYO KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/579,137

(22) Filed: Sep. 23, 2019

(65) Prior Publication Data

US 2020/0103813 A1 Apr. 2, 2020

(30) Foreign Application Priority Data

Sep. 28, 2018 (JP) ..... 2018-184208

(51) Int. Cl.
*G03G 15/08* (2006.01)
*G03G 15/00* (2006.01)
*G03G 21/16* (2006.01)

(52) U.S. Cl.
CPC ..... *G03G 15/751* (2013.01); *G03G 21/1652* (2013.01)

(58) Field of Classification Search
CPC ..... G03G 15/751; G03G 21/1652
See application file for complete search history.

(56) References Cited

U.S. PATENT DOCUMENTS

| | | | | |
|---|---|---|---|---|
| 2007/0230999 | A1 | 10/2007 | Shimomura | |
| 2008/0019204 | A1 | 1/2008 | Jin | |
| 2008/0240774 | A1 | 10/2008 | Fukamachi et al. | |
| 2010/0135693 | A1 | 6/2010 | Okabe et al. | |
| 2013/0223869 | A1 | 8/2013 | Oda | |
| 2019/0196394 | A1* | 6/2019 | Yabuki | G03G 21/1814 |

FOREIGN PATENT DOCUMENTS

| | | | |
|---|---|---|---|
| JP | 2007-271895 | A | 10/2007 |
| JP | 2008-203566 | A | 9/2008 |
| JP | 2008-249801 | A | 10/2008 |
| JP | 2008-249802 | A | 10/2008 |
| JP | 2010-128336 | A | 6/2010 |
| JP | 2010-175619 | A | 8/2010 |
| JP | 2013-174723 | A | 9/2013 |

* cited by examiner

*Primary Examiner* — Clayton E. LaBalle
*Assistant Examiner* — Michael A Harrison
(74) *Attorney, Agent, or Firm* — Merchant & Gould P.C.

(57) ABSTRACT

A drum cartridge includes a first photosensitive drum, a frame, a first toner cartridge connector, a first harness, and a protection wall. The first photosensitive drum is rotatable about a first drum axis extending in a first direction. The first harness is electrically connected to the first toner cartridge connector. The first harness extends in a second direction intersecting the first direction. The protection wall extends in the second direction and positioned between the inner surface of the first side plate and the second side plate. The first harness is received between the protection wall and the inner surface of the first side plate.

35 Claims, 8 Drawing Sheets

DRUM CARTRIDGE AND IMAGE FORMING APPARATUS

CROSS-REFERENCE TO RELATED APPLICATION

This application claims priority from Japanese Patent Application No. 2018-184208 filed on Sep. 28, 2018, the content of which is incorporated herein by reference in its entirety.

TECHNICAL FIELD

Aspects described herein relate to a drum cartridge and an image forming apparatus.

BACKGROUND

A known electrophotographic image forming apparatus such as a laser printer or an LED printer includes a drum cartridge. The drum cartridge includes a plurality of photosensitive drums. A plurality of toner cartridges is detachably attachable to the drum cartridge. In a state where a toner cartridge is attached to the drum cartridge, a circumferential surface of a developing roller of the toner cartridge contacts a circumferential surface of a corresponding photosensitive drum of the drum cartridge.

SUMMARY

Some known toner cartridge may include a memory. The memory of the toner cartridge may store various information about the toner cartridge. The image forming apparatus may be configured such that a plurality of toner cartridges each including such a memory is detachably attachable to the image forming apparatus. Nevertheless, an amount of information to be processed in a main body of the image forming apparatus may increase proportionally with increases in the number of toner cartridges to be attached to the main body of the image forming apparatus. That is, an amount of information to be transmitted between each of the toner cartridges and the image forming apparatus may increase proportionally with increases in the number of toner cartridges.

In some cases, in a state where a drum cartridge having a toner cartridge attached is attached to the main body of the image forming apparatus, the main body of the image forming apparatus may read information from the memory of the toner cartridge via the drum cartridge.

For implementing such information communication, a harness may be routed in the drum cartridge. In such a case, the harness may need to be routed so as not to contact the toner cartridge during attachment of the toner cartridge to the drum cartridge.

Accordingly, some embodiments of the disclosure provide for a drum cartridge having a configuration that may reduce or prevent a toner cartridge from contacting the harness routed in the drum cartridge during attachment of the toner cartridge to the drum cartridge.

A first aspect of the disclosure provides a drum cartridge with structure described below. The drum cartridge includes a first photosensitive drum, a frame, a first toner cartridge connector, a first harness, and a protection wall. The first photosensitive drum is rotatable about a first drum axis extending in a first direction. The frame includes a first side plate and a second side plate. The first side plate is positioned at one side of the first photosensitive drum in the first direction. The second side plate is positioned at the other side of the first photosensitive drum in the first direction. The first toner cartridge connector is positioned at an inner surface of the first side plate. The first harness is electrically connected to the first toner cartridge connector. The first harness is positioned at the inner surface of the first side plate. The first harness extends in a second direction intersecting the first direction. The protection wall extends in the second direction and positioned between the inner surface of the first side plate and the second side plate.

The first harness is received between the protection wall and the inner surface of the first side plate.

A second aspect of the disclosure provides a drum cartridge with described below. The drum cartridge includes comprising: a first photosensitive drum, a frame, a first toner cartridge connector, and a first harness. The first photosensitive drum is rotatable about a first drum axis extending in a first direction. The frame holds the first photosensitive drum. The frame includes a first side plate and a second side plate. The first side plate is positioned at one side of the first photosensitive drum in the first direction. The second side plate is positioned at the other side of the first photosensitive drum in the first direction. The first toner cartridge connector is positioned at an inner surface of the first side plate. The first harness is electrically connected to the first toner cartridge connector. The first harness is positioned at the inner surface of the first side plate. The first harness extends in a second direction intersecting the first direction.

The first side plate has a groove. The groove extends toward an outer surface of the first side plate from the inner surface of the first side plate in the first direction to define a harness placement space. The harness placement space has therein the first harness, the harness placement space extending in the second direction.

According to the one or more aspects of the disclosure, the toner cartridge might not contact the harness during attachment of the toner cartridge to the drum cartridge.

DETAILED DESCRIPTION

An illustrative embodiment will be described with reference to the accompanying drawings.

In the following description, a direction in which a rotating shaft of each photosensitive drum extends may be defined as a first direction. A direction in which the photosensitive drums are arranged one behind another may be defined as a second direction. The first direction and the second direction may intersect each other (preferably at right angles). A direction intersecting both of the first and second directions (preferably at right angles) may be defined as a third direction. In each units or components, an end positioned on one side of the unit or the component in each direction may be referred to as one end, and an opposite end positioned on the other side of the unit or the component in each direction may be referred to as the other end.

1. Illustrative Embodiment

1-1. Configuration of Image Forming Apparatus

Figure 1:
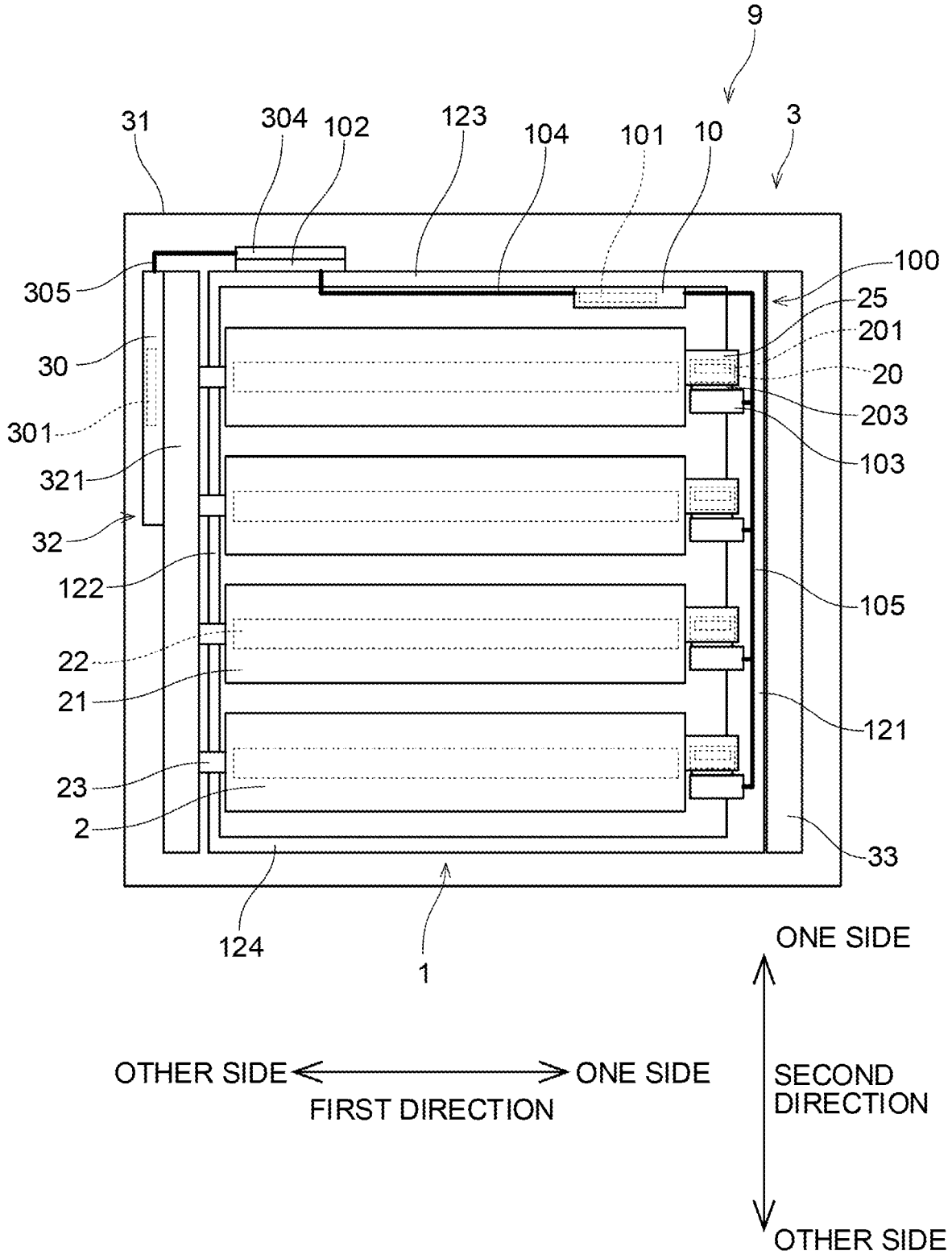
FIG. 1 is a schematic diagram of an image forming apparatus in an illustrative embodiment according to one or more aspects of the disclosure.

An image forming apparatus 9 according to the illustrative embodiment may be an electrophotographic printer. Examples of the image forming apparatus 9 include laser printers and LED printers. As illustrated in FIG. 1, the image forming apparatus 9 includes a drum cartridge 1, a plurality of toner cartridges 2, and a main body 3.

The drum cartridge 1 includes a circuit unit 100. The circuit unit 100 includes a drum-cartridge circuit board 10, a drum-cartridge memory 101, a main body connector 102, a plurality of toner cartridge connectors 103, a wiring harness or harness 104, and a plurality of harnesses 105.

The drum-cartridge memory 101 may be a readable and rewritable storage medium. The main body connector 102 is configured to be electrically connected to the main body 3 in a state where the drum cartridge 1 is attached to the main body 3. The toner cartridge connectors 103 are configured to be electrically connected to respective toner-cartridge circuit boards 20 in a state where the toner cartridges 2 are attached to the drum cartridge 1. In the illustrative embodiment, the drum cartridge 1 allows four toner cartridges 2 to be attached thereto, and thus the circuit unit 100 includes four toner cartridge connectors 103.

The harnesses 104 and 105 may be wire harnesses that electrically connect between the main body connector 102 and the respective toner cartridge connectors 103. More specifically, for example, the harness 104 electrically connects between the drum-cartridge circuit board 10 and the main body connector 102. Each of the harnesses 105 electrically connects between the drum-cartridge circuit board 10 and a corresponding one of the toner cartridge connectors 103.

The toner cartridges 2 are attachable to the drum cartridge 1 individually. The drum cartridge 1 having the toner cartridges 2 attached thereto is attachable to a casing 31 of the main body 3.

The toner cartridges 2 store toners (developer) of respective different colors (e.g., cyan, magenta, yellow, and black). The image forming apparatus 9 is configured to form an image onto a surface of a sheet using toner supplied from the toner cartridges 2. In the illustrative embodiment, the number of toner cartridges 2 to be attached to the drum cartridge 1 may be four. Nevertheless, the number of toner cartridges 2 to be attached to the drum cartridge 1 might not be limited to the specific example. In other embodiments, for example, the number of toner cartridges 2 to be attached to the drum cartridge 1 may be at least one, or may be less than or more than four.

All of the toner cartridges 2 may have the same configuration. Therefore, one of the toner cartridges 2 will be described in detail and a description for the others will be omitted. A toner cartridge 2 includes a toner-cartridge circuit board 20, a toner-cartridge memory 201, and a connector 203. The toner-cartridge memory 201 may be a readable and rewritable storage medium. The connector 203 of the toner cartridge 2 is configured to be electrically connected to a corresponding one of the toner cartridge connectors 103 of the drum cartridge 1 in a state where the toner cartridge 2 is attached to the drum cartridge 1.

Such a configuration may thus enable the toner-cartridge circuit board 20 of each of the toner cartridges 2 and the drum-cartridge circuit board 10 to be electrically connected to each other in a state where the toner cartridges 2 are attached to the drum cartridge 1. In a state where the drum cartridge 1 having the toner cartridges 2 attached is attached to the casing 31 of the main body 3 of the image forming apparatus 9, the drum-cartridge circuit board 10 is electrically connected to a controller 30 of the main body 3. Thus, the toner-cartridge circuit board 20 of each of the toner cartridges 2 is electrically connected to the controller 30 via the drum-cartridge circuit board 10. That is, the drum-cartridge circuit board 10 may be a relay board that relays information between the toner-cartridge memory 201 of each of the toner cartridges 2 and the controller 30 of the main body 3.

1-2. Configuration of Drum Cartridge

As illustrated in FIGS. 1 to 4, the drum cartridge 1 includes a plurality of photosensitive drums 11, a frame 12, and the circuit unit 100. The drum cartridge 1 is detachably attachable to the casing 31 of the main body 3 of the image forming apparatus 9. More specifically, for example, the drum cartridge 1 is attachable to and detachable from of the casing 31 of the main body 3 of the image forming apparatus 9 in the second direction. That is, the second direction may correspond to an attaching/detaching direction in which the drum cartridge 1 is attached to and detached from the casing 31 of the main body 3 of the image forming apparatus 9.

Each photosensitive drum 11 is configured to transfer toner supplied from a corresponding toner cartridge 2 onto a sheet. The photosensitive drums 11 are spaced from each other in the second direction. The photosensitive drums 11 are positioned at the other end portion of the drum cartridge 1 in the third direction. Each photosensitive drum 11 has a cylindrical shape extending in the first direction. Each photosensitive drum 11 has a circumferential surface. The circumferential surface of each photosensitive drum 11 is covered by photosensitive material.

In the illustrative embodiment, the photosensitive drums 11 are equal in number to the toner cartridges 2 allowed to be attached to the drum cartridge 1. That is, the drum cartridge 1 includes four photosensitive drums 11. The photosensitive drums 11 include first, second, third, and fourth photosensitive drums 11A, 11B, 11C, and 11D. The photosensitive drums 11A, 11B, 11C, and 11D are spaced from each other in the second direction.

The first photosensitive drum 11A is rotatable about a first drum axis 110A extending in the first direction. The second photosensitive drum 11B is rotatable about a second drum axis 110B extending in the first direction. The third photosensitive drum 11C is rotatable about a third drum axis 110C extending in the first direction. The fourth photosensitive drum 11D is rotatable about a fourth drum axis 110D extending in the first direction.

Figure 2:
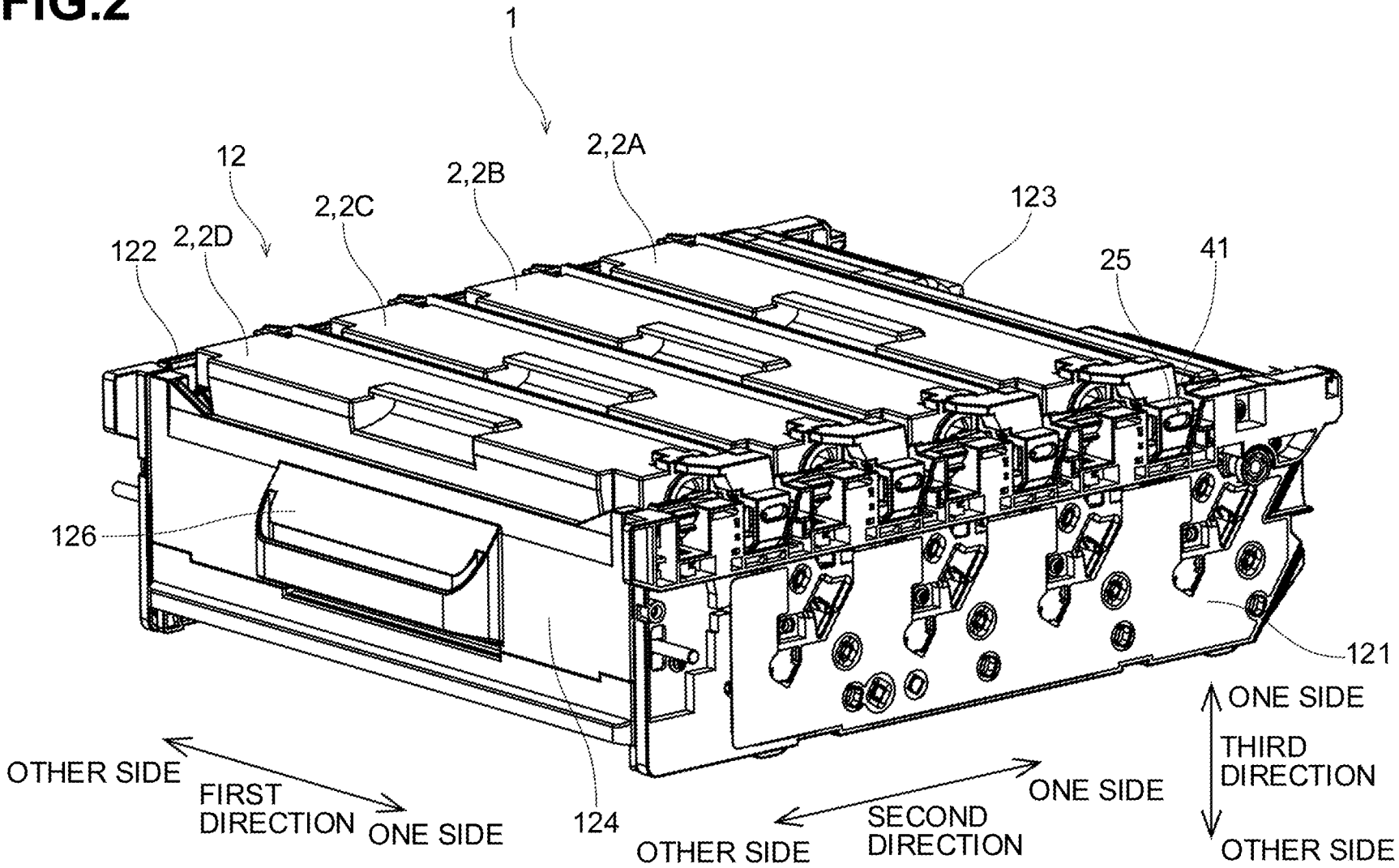
FIG. 2 is a perspective view of a drum cartridge in the illustrative embodiment according to one or more aspects of the disclosure.
Figure 3:
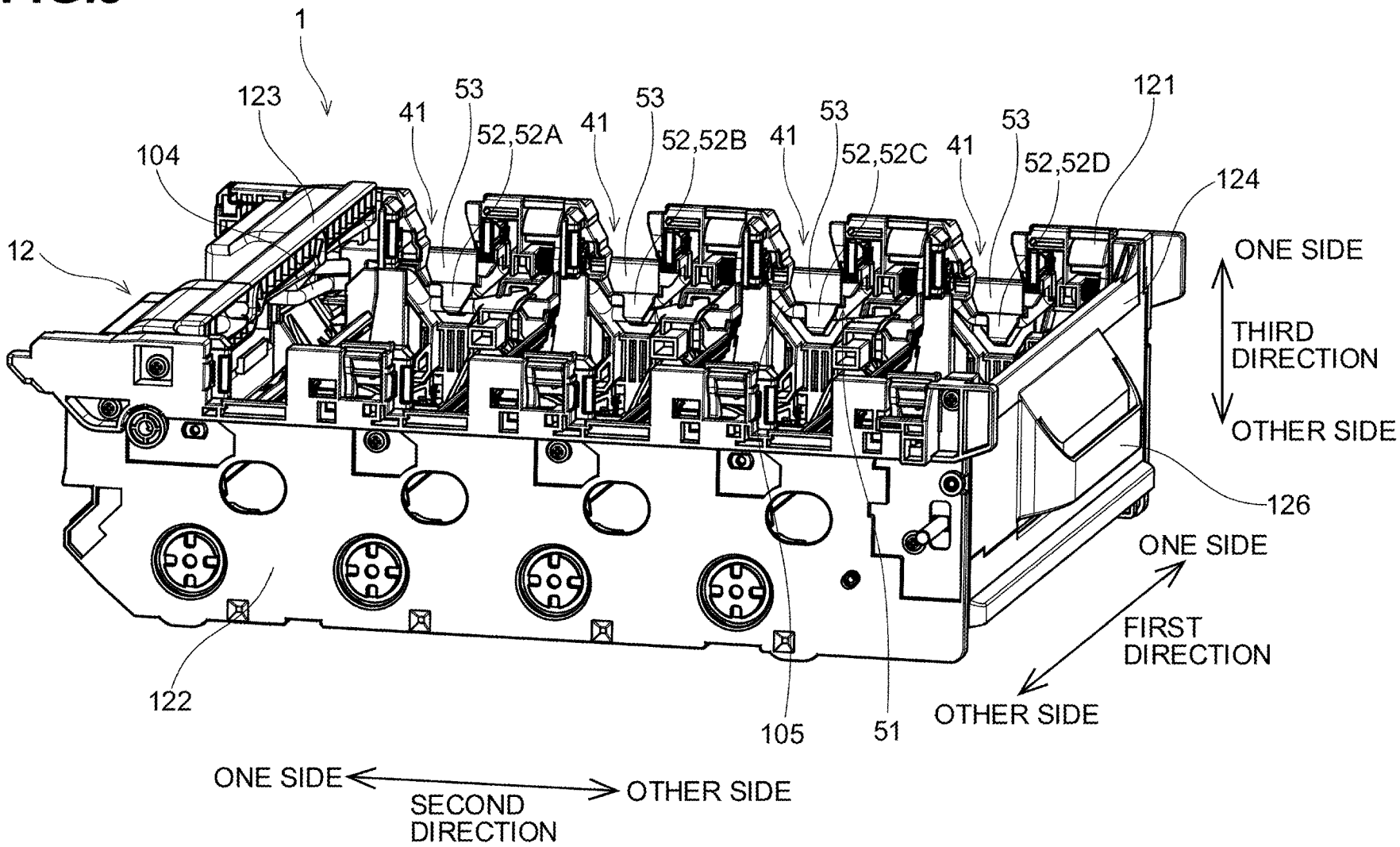
FIG. 3 is a perspective view of the drum cartridge in the illustrative embodiment according to one or more aspects of the disclosure.
Figure 4:
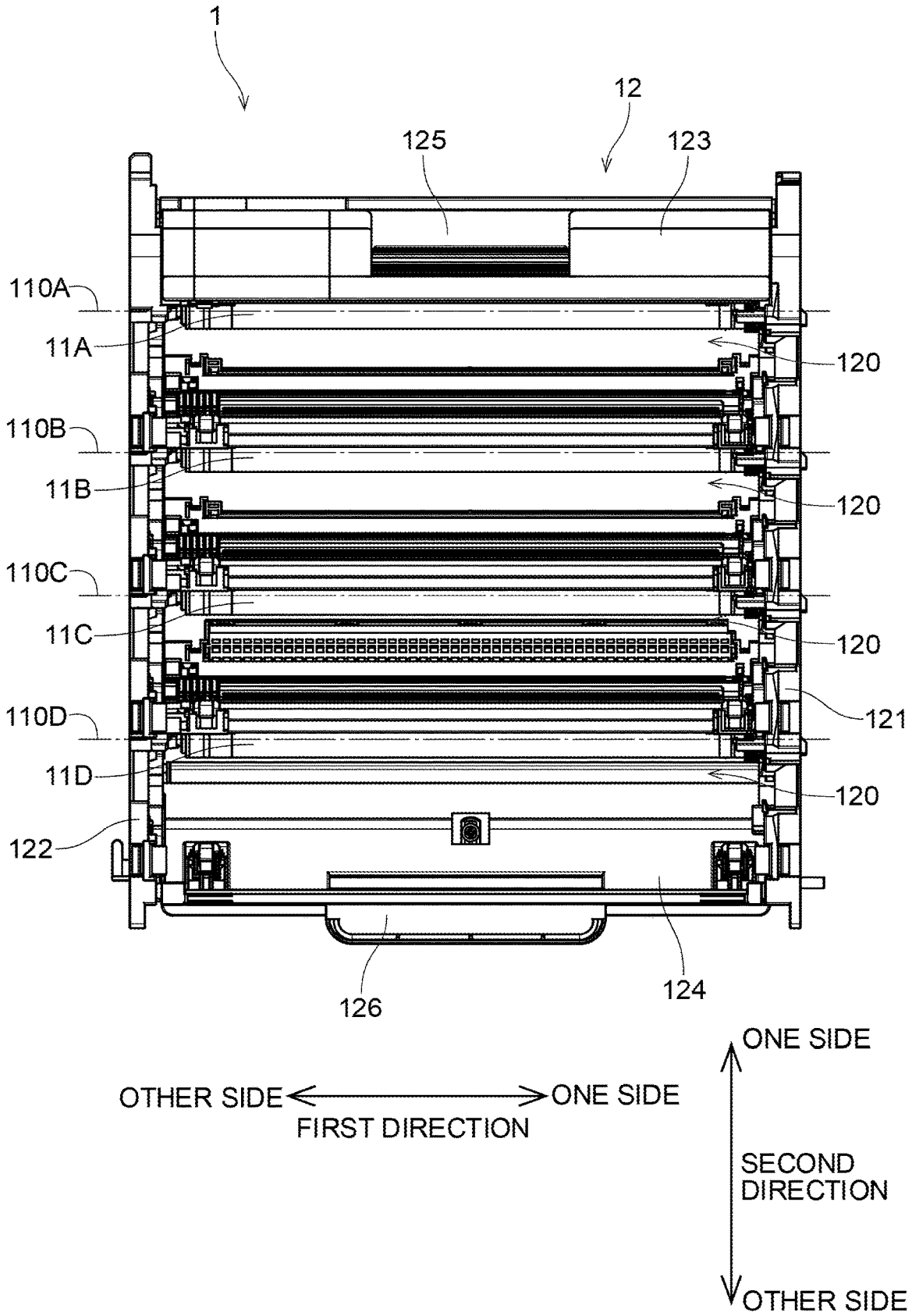
FIG. 4 is a plan view of the drum cartridge in the illustrative embodiment according to one or more aspects of the disclosure.

As illustrated in FIGS. 2, 3, and 4, the frame 12 holds the photosensitive drums 11. The frame 12 includes a first side plate 121, a second side plate 122, a first connecting plate 123, and a second connecting plate 124.

The first side plate 121 is positioned at one end portions of the photosensitive drums 11 in the first direction. The second side plate 122 is positioned at the other end portions of the photosensitive drums 11 in the first direction. The second side plate 122 is spaced from the first side plate 121 in the first direction.

The first connecting plate 123 connects between one end portion of the first side plate 121 and one end portion of the second side plate 122 in the second direction. The second connecting plate 124 connects between the other end portion of the first side plate 121 and the other end portion of the second side plate 122 in the second direction. The second connecting plate 124 is spaced from the first connecting plate 123 in the second direction. In a state where the drum cartridge 1 is attached to the casing 31 of the main body 3, the photosensitive drums 11 are positioned between the first side plate 123 and the second side plate 124 in the second direction.

The frame 12 includes a plurality of toner cartridge holders 120. The toner cartridge holders 120 are spaced from each other in the second direction. The toner cartridge holders 120 include first, second, third, and fourth toner cartridge holders. The toner cartridges 2 may be attached to the respective toner cartridge holders 120. The toner cartridges 2 include first, second, third, and fourth toner cartridges 2A, 2B, 2C, and 2D. That is, the frame 12 is allowed to receive a plural number of toner cartridges 2. The first toner cartridge holder is allowed to receive the first toner cartridge 2A. The second toner cartridge holder is allowed to receive the second toner cartridge 2B. The third toner cartridge holder is allowed to receive the third toner cartridge 2C. The fourth toner cartridge holder is allowed to receive the fourth toner cartridge 2D. In a state where a toner cartridge 2 is attached to a corresponding toner cartridge holder 120, a circumferential surface of a corresponding photosensitive drum 11 contacts a circumferential surface of a developing roller 22 of the toner cartridge 2.

In a state where the toner cartridges 2 are attached to the frame 12, the toner cartridges 2 are positioned between an inner surface of the first side plate 121 and an inner surface of the second side plate 122 in the first direction. The first side plate 121 includes holder placement portions 41 for receiving holders 25 of the respective toner cartridges 2. Each holder placement portion 41 is recessed toward the other end of the frame 12 in the third direction from the one end of the frame 12 in the third direction. The holders 25 of the toner cartridges 2 may be positioned in the respective holder placement portions 41 in a state where the toner cartridges 2 are attached to the frame 12. In such a state, thus, one end of each of the holders 25 in the first direction are bare of the first side plate 121.

In a state where the toner cartridges 2 are attached to the frame 12, the toner cartridges 2 are positioned between an inner surface of the first connecting plate 123 and an inner surface of the second connecting plate 124 while being spaced from each other in the second direction.

Figure 5:
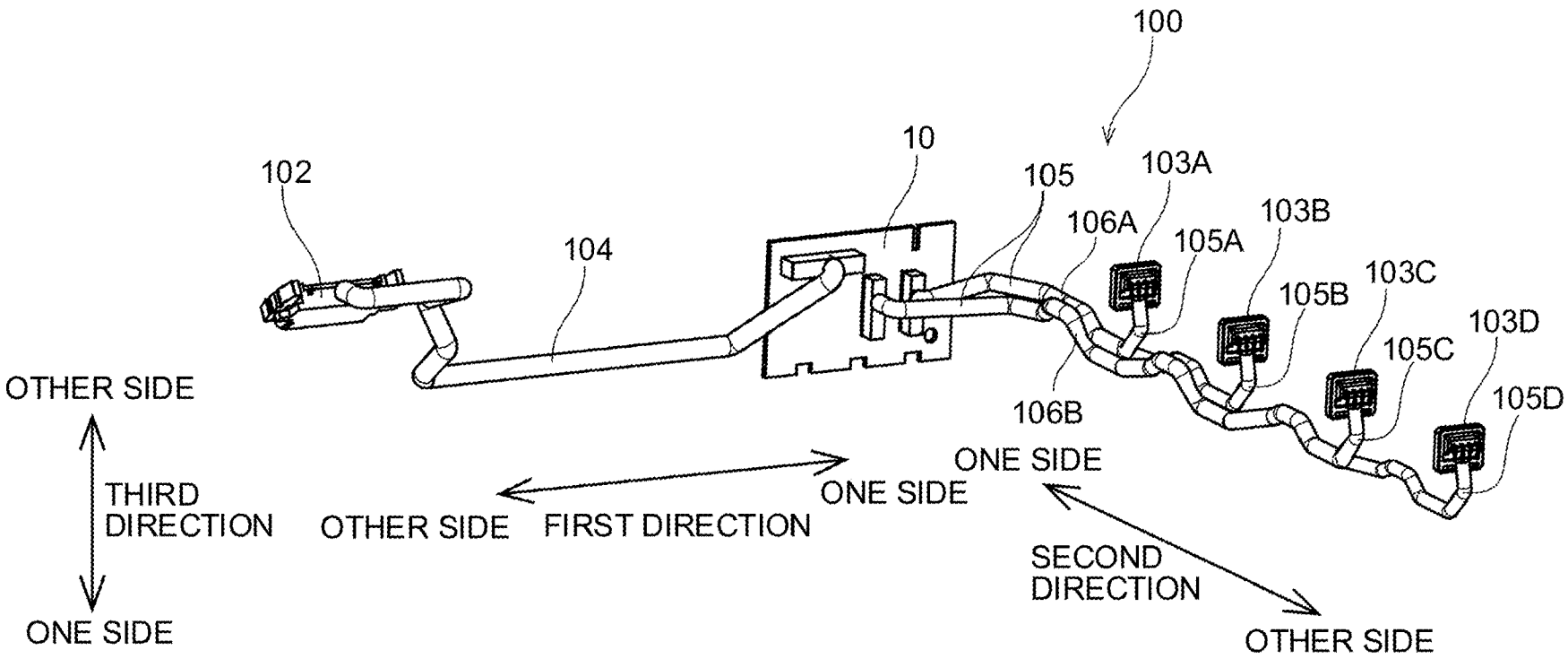
FIG. 5 is a perspective view of a circuit unit in the illustrative embodiment according to one or more aspects of the disclosure.

As illustrated in FIGS. 1 and 5, the drum cartridge 1 includes the circuit unit 100. As described above, the circuit unit 100 includes the drum-cartridge circuit board 10, the drum-cartridge memory 101, the main body connector 102, the plurality of toner cartridge connectors 103, and the harnesses 104 and 105. The toner cartridge connectors 103 include first, second, third, and fourth connector 103A, 103B, 103C, and 103D. The harnesses 105 include first, second, third, and fourth harness 105A, 105B, 105C, and 105D.

The drum-cartridge circuit board 10 is electrically connected to the main body connector 102 and each of the toner cartridge connectors 103. The drum-cartridge circuit board 10 is positioned at an inner surface of the one end portion of the first connecting plate 123 in the first direction. The drum-cartridge circuit board 10 may be a relay board that electrically relays information between the main body connector 102 and each of the toner cartridge connectors 103. As illustrated in FIGS. 1 and 5, the drum-cartridge circuit board 10 and the main body connector 102 are electrically connected to each other via the harness 104. The drum-cartridge circuit board 10 and each of the toner cartridge connectors 103 are electrically connected to each other via the harnesses 105. The harnesses 104 and 105 may be wire harnesses including a plurality of wires.

The drum-cartridge memory 101 is positioned on the drum-cartridge circuit board 10. The drum-cartridge memory 101 is configured to store various information about the drum cartridge 1. The drum-cartridge memory 101 may store, for example, at least one of information for identifying the drum cartridge 1 (hereinafter, referred to as "identification information") and information indicating features of the drum cartridge 1 (hereinafter, referred to as "feature information"). The identification information may include, for example, at least one of a manufacturing serial number and an identification code certifying that the drum cartridge 1 is genuine. The feature information may include, for example, at least one of conforming models, specifications of the drum cartridge 1, a remaining life of each photosensitive drum 11, charging characteristic of each photosensitive drum 11, information, with respect to each photosensitive drum 11, as to whether the photosensitive drum 11 is yet to be used, the number of rotations of each photosensitive drum 11, the total charging time of each photosensitive drum 11, the number of sheets that have been printed, and an error record. The drum-cartridge memory 101 might not necessarily be positioned on the drum-cartridge circuit board 10. In other embodiments, for example, the drum-cartridge memory 101 may be positioned at the frame 12.

The drum-cartridge memory 101 includes a first storage area and a second storage area. The first storage area may be an unrewritable area for storing information that should not be rewritten. The second storage area may be a rewritable area for storing information that may be rewritten or updated. The first storage area may store, for example, at least one of the manufacturing serial number, the identification code, the conforming models, the specification, the remaining life of each photosensitive drum 11, and the charging characteristic of each photosensitive drum 11. The second storage area may store, for example, usage condition of the drum cartridge 1. The usage condition of the drum cartridge 1 may be, for example, the information, with respect to each of the photosensitive drums 11, as to whether the photosensitive drum 11 is yet to be used, the number of rotations of each photosensitive drum 11, the total charging time of each photosensitive drum 11, the number of sheets that have been printed, and the error record.

The drum-cartridge memory 101 may also store information about the toner cartridges 2. For example, the drum-cartridge memory 101 may store identification information about each of the toner cartridges 2 attached to the drum cartridge 1. The identification information may be read from the toner-cartridge memory 201 of each of the toner cartridges 2 and written into the drum-cartridge memory 101 of the drum-cartridge circuit board 10. It may be thus determined that, based on the information stored in the drum-cartridge memory 101, with respect to each of the toner cartridges 2 currently attached to the drum cartridge 1, whether the toner cartridge 2 has been used before or not. Nevertheless, the drum-cartridge memory 101 might not necessarily be configured to store information about the toner cartridges 2.

The drum-cartridge memory 101 may store a usage history of each of the toner cartridges 2 attached to the drum cartridge 1. The usage history of each of the toner cartridges 2 may be, for example, at least one of the number of rotations of the developing roller 22, an amount of toner used, and an error record of the toner cartridge 2. Storing such a usage history of each of the toner cartridges 2 in the drum-cartridge memory 101 may enable the controller 30 to analyze an error occurring in each of the toner cartridges 2 by referring to the drum-cartridge memory 101 but not referring to the toner-cartridge memory 201 of each of the toner cartridges 2. Nevertheless, the drum-cartridge memory 101 might not necessarily be configured to store such a usage history of each of the toner cartridges 2 attached to the drum cartridge 1.

In a state where the drum cartridge 1 is attached to the casing 31 of the main body 3 of the image forming apparatus 9, the main body connector 102 contacts a connector 304 of the main body 3 to be electrically connected to the connector 304. The first connecting plate 123 includes one end and the other end in the first direction. The one end of the first connecting plate 123 connects the one end portion of the first side plate 121 in the second direction. The other end of the first connecting plate 123 connects the one end portion of the second side plate 122 in the second direction. The main body connector 102 is positioned at an outer surface of the other end portion of the first connecting plate 123 in the first direction.

Each of the toner cartridge connectors 103 is configured to, in a state where the toner cartridge 2 is attached to the drum cartridge 1, be electrically connected to the connector 203 of a corresponding toner cartridge 2. The toner cartridge connector 103 is provided for each of the toner cartridge holder 120. In each of the toner cartridge holders 120, the toner cartridge connector 103 is positioned at one end portion of the toner cartridge holder 120 in the first direction. The toner cartridge connectors 103 are positioned at the one end portion of the first side plate 121 in the third direction. The toner cartridge connectors 103 are fixed to, for example, the surface of the frame 12. Nevertheless, in other embodiments, for example, the toner cartridge connectors 103 may be supported by the frame 12 so as to be slightly movable relative to the frame 12.

The first connecting plate 123 of the frame 12 includes a first handle 125. The second connecting plate 124 of the frame 12 includes a second handle 126. The first handle 125 and the second handle 126 each enable a user to hold the drum cartridge 1. The first handle 125 has an opening penetrating the first connecting plate 123 in the third direction. The second handle 126 has an opening penetrating the second connecting plate 124 in the second direction or a recessed portion being recessed toward one end of the second connecting plate 124 in the third direction from other end of the second connecting plate 124 in the third direction.

In the illustrative embodiment, the first handle 125 is positioned between the main body connector 102 and the drum-cartridge circuit board 10 in the first direction. That is, the first handle 125 does not overlap the main body connector 102 and the drum-cartridge circuit board 10 in the third direction. Such a configuration may thus provide a large space for receiving in each of the main body connector 102 and the drum-cartridge circuit board 10 in the third direction.

1-3. Configuration of Toner Cartridges

The configuration of each of the toner cartridges 2 attached to the drum cartridge 1 will be described with reference to the first direction, the second direction, and the third direction. All of the toner cartridges 2 may have the same configuration, and therefore, the description will be provided with respect to one of the toner cartridges 2.

As illustrated in FIGS. 1 and 2, a toner cartridge 2 includes a casing 21, a developing roller 22, a plurality of gears, a coupling 23, a gear cover, a toner-cartridge circuit board 20, a toner-cartridge memory 201, and a connector 203.

The casing 21 includes a toner storage chamber for storing toner. The casing 21 has an opening.

The developing roller 22 is rotatable about an axis extending in the first direction. The developing roller 22 is positioned at the opening of the casing 21. That is, the developing roller 22 is positioned at the other end of the casing 21 in the third direction. In a state where the toner cartridge 2 is attached to the drum cartridge 1, a circumferential surface of the developing roller 22 contacts a circumferential surface of a corresponding photosensitive drum 11.

Toner is supplied from the toner storage chamber to the circumferential surface of the photosensitive drum 11 via the developing roller 22. Toner held by the circumferential surface of the developing roller 22 then moves to the circumferential surface of the photosensitive drum 11 in accordance with an electrostatic latent image formed on the circumferential surface of the photosensitive drum 11. The electrostatic latent image is thus visualized on the circumferential surface of the photosensitive drum 11.

The gears, the coupling 23, and the gear cover are positioned at the outer surface of the other end of the casing 21 in the first direction. The gear cover is positioned at the outer surface of the other end of the casing 21 in the first direction. For example, the gear cover may be fixed to the casing 21 using screws. At least one or more of the gears are positioned between the outer surface of the one end of the casing 21 and the gear cover in the first direction. The coupling 23 is not covered by the gear cover. In a state where the drum cartridge 1 having the toner cartridges 2 is attached to the image forming apparatus 9, drive shafts of the image forming apparatus 9 are connected to the respective couplings 23 of the toner cartridges 2. Rotation of each drive shaft is transmitted to a corresponding one of the developing rollers 22 via a corresponding coupling 23 and gears.

The toner-cartridge circuit board 20, the toner-cartridge memory 201, and the connector 203 are held by the holder 25. The holder 25 is positioned in a corresponding holder placement portion 41 of the first side plate 121. The holder 25 be preferably movable in the second direction relative to the casing 21 and the gear cover. The connector 203 of the toner cartridge 2 is positioned at the other end of the holder 25 in the second direction. The toner-cartridge circuit board 20, the toner-cartridge memory 201, the connector 203, and the holder 25 are positioned at the outer surface of one end portion of the casing 21 in the first direction.

The toner cartridge 2 includes the toner-cartridge memory 201 that may be a storage medium. The toner-cartridge memory 201 is positioned on the toner-cartridge circuit board 20. The toner-cartridge memory 201 is configured to store various information about the toner cartridge 2. The toner-cartridge memory 201 may store, for example, at least one of information for identifying the toner cartridge 2 (hereinafter, referred to as "identification information") and information indicating features of the toner cartridge 2 (hereinafter, referred to as "feature information"). The identification information may include, for example, at least one of a manufacturing serial number and an identification code certifying that the toner cartridge 2 is genuine. The feature information may include, for example, at least one of conforming models, specifications of the toner cartridge 2, a toner capacity of the toner cartridge 2, a remaining life of the developing roller 22, information as to whether the toner cartridge 2 is yet to be used, the number of rotations of the developing roller 22, the number of sheets that have been printed, and the error record. The toner-cartridge memory 201 might not necessarily be positioned on the toner-cartridge circuit board 20. In other embodiments, for example, the toner-cartridge memory 201 may be positioned on the casing 21.

1-4. Main Body

Referring to FIGS. 1 to 6, the main body 3 will be described. As illustrated in FIG. 1, the main body 3 further includes the controller 30, the casing 31, a board placement portion 32, and a voltage supply 33. The controller 30 is positioned in the casing 31.

Figure 6:
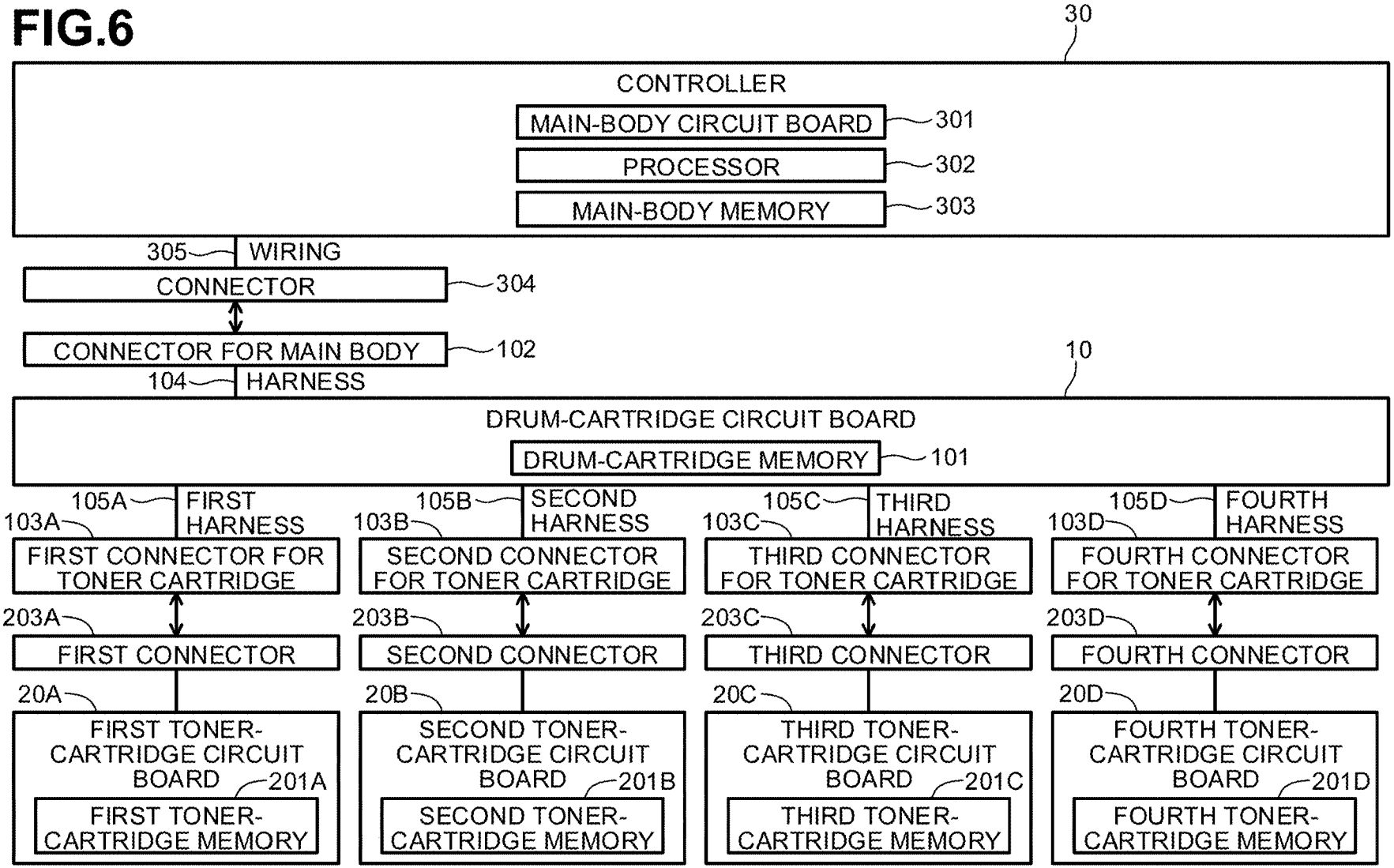
FIG. 6 is a block diagram of an electrical connection between a controller, a drum-cartridge circuit board, and toner-cartridge circuit boards in the illustrative embodiment according to one or more aspects of the disclosure.

As illustrated in FIG. 6, the controller 30 includes a main-body circuit board 301, a processor 302 such as a CPU, and a main-body memory 303. The controller 30 is configured to execute various processing in the image forming apparatus 9 in response to operation of the processor 302 in accordance with the program.

The casing 31 accommodates the board placement portion 32 and the voltage supply 33. The drum cartridge 1 may be attached to the casing 31.

In a state where the drum cartridge 1 having the toner cartridges 2 is attached to the casing 31, the controller 30 and a drive-force input unit 321 are positioned in the board placement portion 32. In a state where the drum cartridge 1 is attached to the casing 31, the board placement portion 32 is positioned to the other side of the second side plate 122 in the first direction and faces the outer surface of the second side plate 122 in the first direction. The drive-force input unit 321 includes the drive shafts that are configured to, in a state where the drum cartridge 1 is attached to the casing 31, be connected to the respective couplings 23 of the toner cartridges 2. The drive shafts are configured to rotate to transmit drive force to the respective couplings 23 in accordance with an instruction provided by the controller 30.

The main body 3 includes the connector 304 and wiring 305. The connector 304 is configured to be electrically connected to the main body connector 102 of the drum cartridge 1 in a state where the drum cartridge 1 is attached to the casing 31. The wiring 305 electrically connects between the connector 304 and the main-body circuit board 301.

The voltage supply 33 is configured to supply a bias voltage to the photosensitive drums 11 of the drum cartridge 1 and the developing rollers 22 of the toner cartridges 2. In a state where the drum cartridge 1 is attached to the casing 31, the voltage supply 33 is positioned to the one end portion of the first side plate 121 in the first direction and faces the outer surface of the first side plate 121 in the first direction.

1-5. Position of Circuit Unit of Drum Cartridge

Referring to FIGS. 1 to 5, the position of the circuit unit 100 of the drum cartridge 1 will be described.

As illustrated in FIG. 1, the connector 304 is electrically connected to the controller 30 in the main body 3. The board placement portion 32 is positioned at the other end portion of the casing 31 in the first direction. The connector 304 may thus preferably be positioned at the other end portion of the frame 12 in the first direction.

The connector 304 to be connected to the main body connector 102 is positioned at the outer surface of the other end portion of the first connecting plate 123 in the first direction. The drum-cartridge circuit board 10 is positioned at the inner surface of the one end portion of the first connecting plate 123 in the first direction. Thus, the harness 104 that connects between the drum-cartridge circuit board 10 and the main body connector 102 extends along the inner surface of the first connecting plate 123. That is, the harness 104 extends in the first direction.

The toner cartridge connectors 103 to be connected to the respective connectors 203 of the toner cartridges 2 are positioned at the first side plate 121. Thus, the harnesses 105 that connect between the respective toner cartridge connectors 103 and the drum-cartridge circuit board 10 extend along the inner surface of the first side plate 121. That is, the harnesses 105 extend in the second direction.

As described above, the main body connector 102 and the toner cartridge connectors 103 are spaced from each other in the first direction and in the second direction. The drum-cartridge circuit board 10 is positioned at the inner surface of the one end portion of the first connecting plate 123 in the first direction. Such a configuration may thus enable the harness 104 that connects between the main body connector 102 and the drum-cartridge circuit board 10 and the harnesses 105 that connect between each of the toner cartridge connectors 103 and the drum-cartridge circuit board 10 to be routed without being bent greatly.

1-6. Electrical Connection in Image Forming Apparatus

Referring to FIG. 6, an electrical connection between the controller 30, the drum-cartridge circuit board 10, and each of the toner-cartridge circuit boards 20 in the image forming apparatus 9 will be described. The main body connector 102 and the toner cartridge connectors 103 relays information stored in the toner-cartridge memory 201 to the controller 30 in a state where the drum cartridge 1 is attached to the casing 31 of the main body 3.

The toner cartridges 2 include a first toner cartridge 2A, a second toner cartridge 2B, a third toner cartridge 2C, and a fourth toner cartridge 2D in this order from the side close to the one end of the drum cartridge 1 in the second direction.

The toner-cartridge circuit boards 20 of the first, second, third, and fourth toner cartridges 2A, 2B, 2C, and 2D may be referred to as the first, second, third, and fourth toner-cartridge circuit boards 20A, 20B, 20C, and 20D, respectively.

The memories 201 of the first, second, third, and fourth toner cartridges 2A, 2B, 2C, and 2D may be referred to as the first, second, third, and fourth memories 201A, 201B, 201C, and 201D, respectively.

The connectors 203 of the first, second, third, and fourth toner cartridges 2A, 2B, 2C, and 2D may be referred to as the first, second, third, and fourth connectors 203A, 203B, 203C, and 203D, respectively.

The toner cartridge connectors 103 of the circuit unit 100 of the drum cartridge 1 include a first toner cartridge connector 103A, a second toner cartridge connector 103B, a third toner cartridge connector 103C, and a fourth toner cartridge connector 103D. The first toner cartridge connector 103A is configured to be electrically connected to the first toner-cartridge memory 201A of the first toner cartridge 2A. The second toner cartridge connector 103B is configured to be electrically connected to the second toner-cartridge memory 201B of the second toner cartridge 2B. The third toner cartridge connector 103C is configured to be electrically connected to the third toner-cartridge memory 201C of the third toner cartridge 2C. The fourth toner cartridge connector 103D is configured to be electrically connected to the fourth toner-cartridge memory 201D of the fourth toner cartridge 2D.

The harnesses 105 include a first harness 105A, a second harness 105B, a third harness 105C, and a fourth harness 105D. The first harness 105A electrically connects between the first toner cartridge connector 103A and the drum-cartridge circuit board 10. The second harness 105B electrically connects between the second toner cartridge connector 103B and the drum-cartridge circuit board 10. The third harness 105C electrically connects between the third toner cartridge connector 103C and the drum-cartridge circuit board 10. The fourth harness 105D electrically connects between the fourth toner cartridge connector 103D and the drum-cartridge circuit board 10.

Thus, the first harness 105A, the drum-cartridge circuit board 10, and the harness 104 electrically connect between the first toner cartridge connector 103A and the main body connector 102. The second harness 105B, the drum-cartridge circuit board 10, and the harness 104 electrically connect between the second toner cartridge connector 103B and the main body connector 102. The third harness 105C, the drum-cartridge circuit board 10, and the harness 104 connect electrically between the third toner cartridge connector 103C and the main body connector 102. The fourth harness 105D, the drum-cartridge circuit board 10, and the harness 104 connect electrically between the fourth toner cartridge connector 103D and the main body connector 102.

As illustrated in FIG. 5, at least a portion of the first harness 105A and at least a portion of the second harness 105B are covered by a first cover 106A. At least a portion of the third harness 105C and at least a portion of the fourth harness 105D are covered by a second cover 106B.

1-7. Harness Routing

Figure 7:
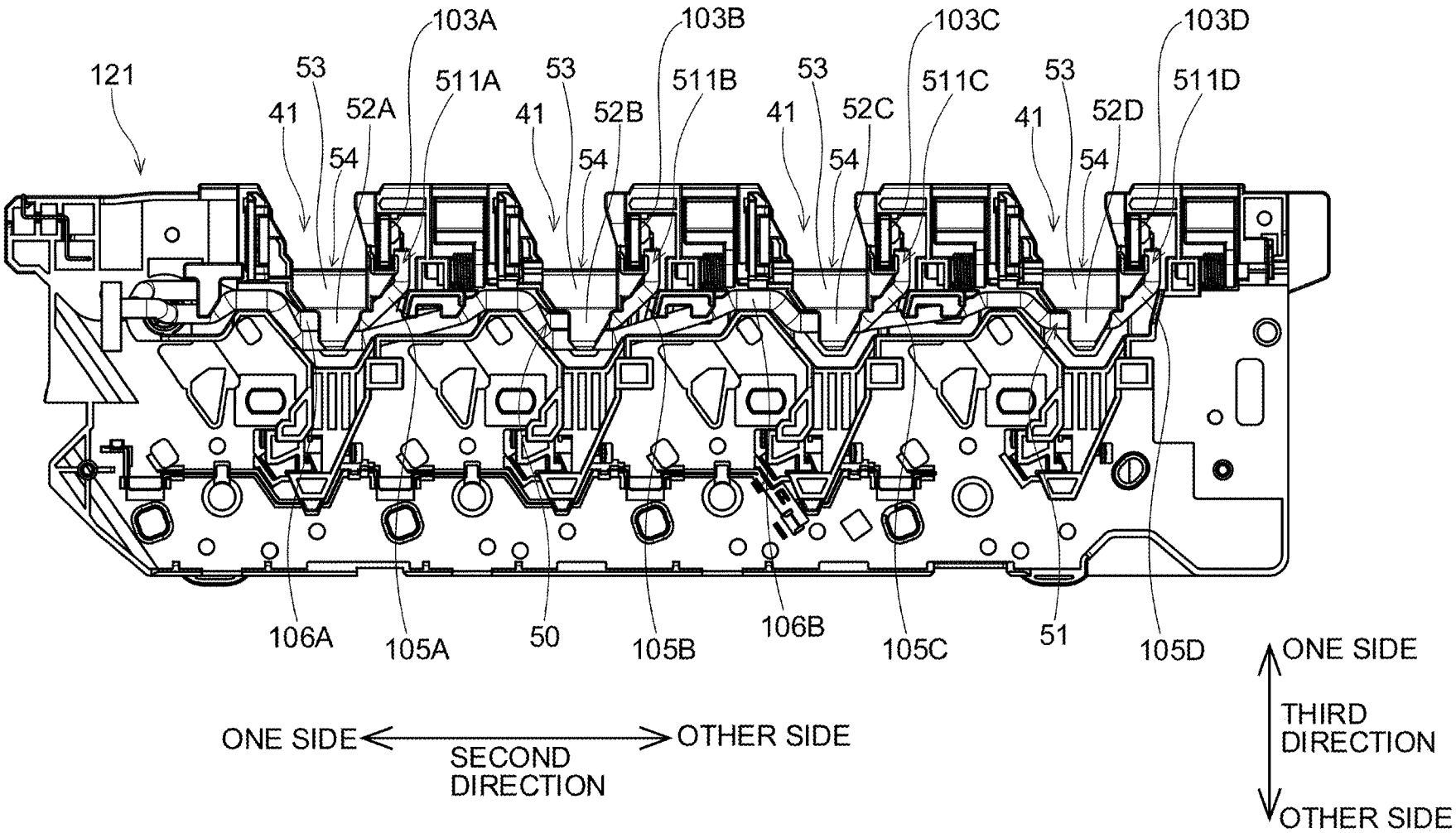
FIG. 7 is a plan view of a first side plate, toner cartridge connectors, and harnesses extending from the toner cartridge connectors in the illustrative embodiment according to one or more aspects of the disclosure.
Figure 8:
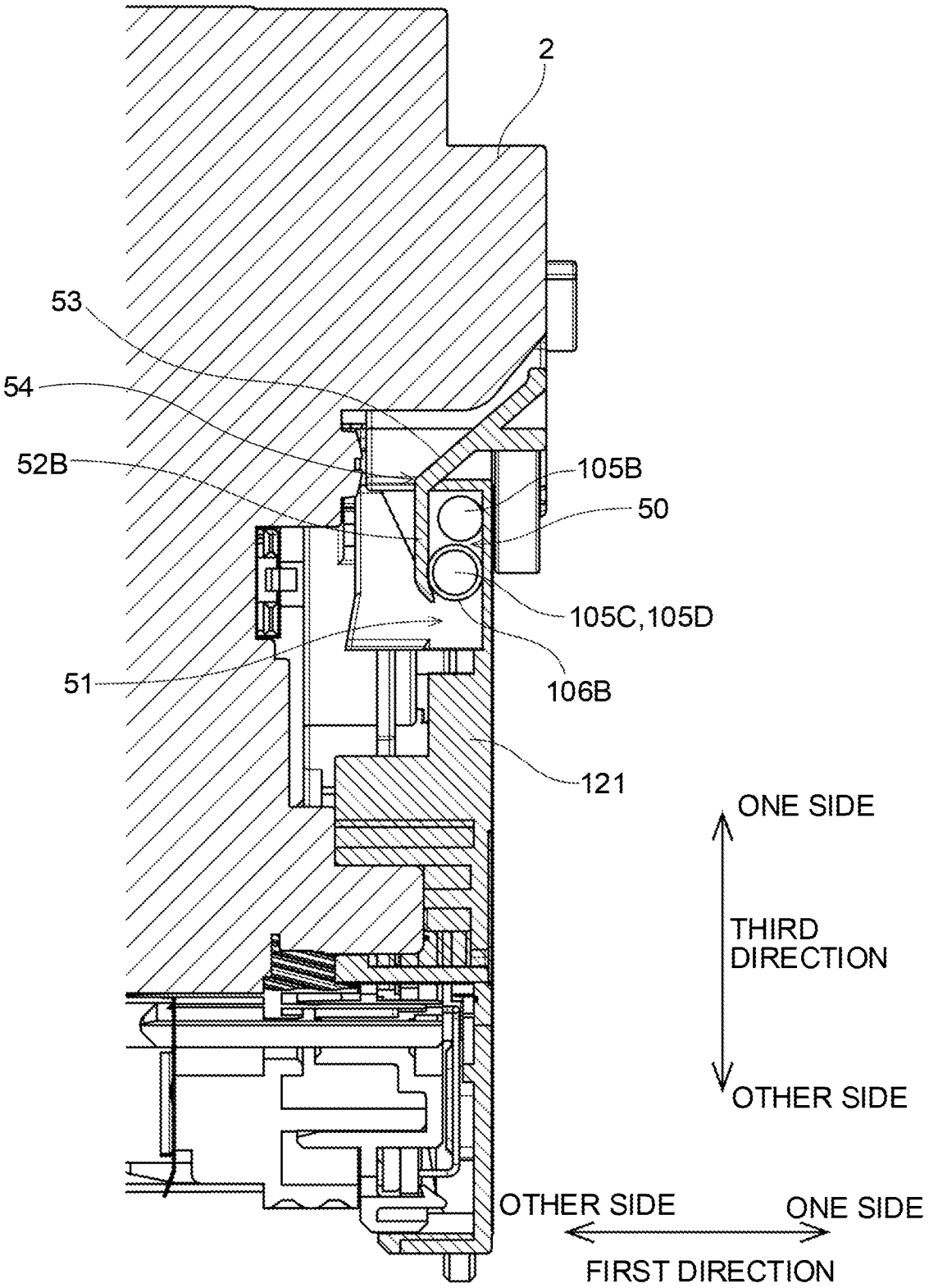
FIG. 8 is a partial sectional view of the drum cartridge to which a toner cartridge is attached in the illustrative embodiment according to one or more aspects of the disclosure.

Referring to FIGS. 7 and 8, routing of the harnesses 105 will be described.

The first side plate 121 has a groove 51. The groove 51 is defined in the inner surface of the first side plate 121. More specifically, for example, the groove 51 is recessed toward the outer surface of the first side plate 121 from the inner surface of the first side plate 121 in the first direction. The groove 51 includes a harness placement space 50 for placing the harnesses 105. The groove 51 and the harness placement space 50 extend in the second direction. The harnesses 105 received in the harness placement space 50 might not interfere with other members or components positioned outside of the harness placement space 50.

The first side plate 121 further includes protection walls 54 having separators 52 extending in the third direction. At least one of the harnesses 105 is received between the protection wall 54 and the inner surface of the first side plate 121. The separators 52 are positioned between at least one of the harnesses 105 and the second side plate 122 in the first direction. More specifically, for example, in a state where the toner cartridges 2 are attached to the frame 12 of the drum cartridge 1, each separator 52 is positioned between a corresponding toner cartridge 2 and at least one of the harnesses 105 in the first direction.

Such a configuration may thus reduce or prevent the harnesses 105 from contacting the toner cartridges 2 during attachment of the toner cartridges 2 to the frame 12 of the drum cartridge 1. Consequently, such a configuration may enable the user to readily attach and detach each toner cartridge 2 to and from the drum cartridge 1.

The separators 52 extend in the third direction from an edge of the groove 51. More specifically, for example, the separators 52 extend from the one end of the first side plate 121 in the third direction toward the other end of the first side plate 121 in the third direction. The groove 51 has a length larger than a length of each separator 52 in the third direction. Thus, a gap is left between the other end of each separator 52 and the other edge of the groove 51 in the third direction.

As illustrated in FIGS. 7 and 8, the protection wall 54 has guide surfaces 53. The guide surfaces 53 are positioned at the one side of the respective separators 52 in the third direction. The separators 52 are positioned between the corresponding photosensitive drum 11 and the guide surfaces 53 in the third direction. That is, the guide surfaces 53 are positioned across the respective separators 53 from the corresponding photosensitive drums 11 in the third direction. Each guide surface 53 is configured to guide a corresponding toner cartridge 2 during attachment of the toner cartridge 2 to the frame 12 of the drum cartridge 1. The guide surfaces 53 extend diagonally from the one end of the first side plate 121 toward the other end of the first side plate 121 in the third direction so as to extend toward the second side plate 122.

In the illustrative embodiment, the first side plate 121 includes four separators 52. The separators 52 are positioned at the one side of the respective toner cartridge connectors 103.

The first side plate 121 has a plurality of, for example, four, sub grooves 511 extending in the third direction. The sub grooves 511 branch off from the groove 51. A portion of each of the harnesses 105 is positioned in a corresponding sub groove 511. The sub grooves 511 include a first sub groove 511A, a second sub groove 511B, a third sub groove 511C, and a fourth sub groove 511D in this order from the side close to the one end of the first side plate 121 in the second direction.

The separators 52 of the first side plate 121 include a first separator 52A, a second separator 52B, a third separator 52C, and a fourth separator 52D in this order from the side close to the one end of the first side plate 121 in the second direction. The second separator 52B is positioned between the first sub groove 511A and the second sub groove 511B in the second direction. The third separator 52C is positioned between the second sub groove 511B and the third sub groove 511C in the second direction. The fourth separator 52D is positioned between the third sub groove 511C and the fourth sub groove 511D in the second direction.

A portion of each harness 105 extending from a corresponding toner cartridge connector 103 is positioned in a corresponding sub groove 511. That is, each harness 105 has a portion extending in the third direction and a portion extending in the second direction.

The fourth harness 105D extends along the fourth sub groove 511D and the groove 51. The third harness 105C extends along the third sub groove 511C and the groove 51. The portion of the third harness 105C positioned in the groove 51 is covered by the second cover 106B together with the fourth harness 105D. That is, the third harness 105C and the fourth harness 105D are positioned in the harness placement space 50 with being covered by the second cover 106B.

The second harness 105B extends along the second sub groove 511B and the groove 51. The first harness 105A extends along the first sub groove 511A and the groove 51. The portion of the first harness 105A positioned in the groove 51 is covered by the first cover 106A together with the second harness 105B. That is, the first harness 105A and the second harness 105B are positioned in the harness placement space 50 with being covered by the first cover 106A.

As described above, the harness placement space 50 accommodates the harnesses 105.

The harness placement space 50 has a first space for receiving the fourth harness 105D only. The first space is defined at the other end portion of the first side plate 121 in the second direction. The harness placement space 50 further has a second space for receiving the covered portions of the third harness 105C and the fourth harness 105D covered by the second cover 106B. The second space is defined between the second separator 52B and the third separator 52C in the second direction. The harness placement space 50 further has a third space for receiving the second harness 105B and the covered portions of the third harness 105C and the fourth harness 105D covered by the second cover 106B. The third space is defined between the first separator 52A and the second separator 52B in the second direction. The harness placement space 50 further has a fourth space for receiving the covered portions of the first harness 105A and the second harness 105B covered by the first cover 106A and the covered portions of the third harness 105C and the fourth harness 105D covered by the second cover 106B. The fourth space is defined at the one end portion of the first side plate 121 in the second direction.

As described above, each of the separators 52 partitions the space of the drum cartridge 1 into the harness placement space 50 and the other space. Such a configuration may thus the harnesses 105 positioned in the harness placement space 50 might not interfere with other members or components located outside of the harness placement space 50.

While the disclosure has been described in detail with reference to the specific embodiment thereof, this is merely an example, and various changes, arrangements and modifications may be applied therein without departing from the spirit and scope of the disclosure.

What is claimed is:

1. A drum cartridge comprising:

a first photosensitive drum rotatable about a first drum axis extending in a first direction;

a frame holding the first photosensitive drum and including:

a first side plate positioned at one side of the first photosensitive drum in the first direction;

a second side plate positioned at the other side of the first photosensitive drum in the first direction; and a first toner cartridge connector positioned at an inner surface of the first side plate, a first harness being electrically connected to the first toner cartridge connector, the first harness positioned at the inner surface of the first side plate, the first harness extending in a second direction intersecting the first direction; and a protection wall extending in the second direction and positioned between the inner surface of the first side plate and the second side plate, wherein the first harness is received between the protection wall and the inner surface of the first side plate, wherein the protection wall includes a first separator spaced apart from the inner surface of the first side plate and extending in a third direction intersecting the first direction and the second direction, the first separator positioned between the first harness and the second side plate in the first direction, and wherein the protection wall includes a guide surface extending diagonally from the inner surface of the first side plate to a top end of the first separator.

2. The drum cartridge according to claim 1, wherein the protection wall includes a guide surface extending from the inner surface of the first side plate towards the second side plate.

3. The drum cartridge according to claim 2, wherein the guide surface extends diagonally from the inner surface of the first side plate towards the second side plate.

4. The drum cartridge according to claim 1, further comprising a second photosensitive drum rotatable about a second drum axis, the second photosensitive drum being positioned between the first side plate and the second side plate in the first direction, the second photosensitive drum spaced from the first photosensitive drum in the second direction.

5. The drum cartridge according to claim 1, wherein the drum cartridge is attachable to a main body in the second direction.

6. The drum cartridge according to claim 1, wherein the frame further includes a first connecting plate connecting between one end of the first side plate in the second direction and one end of the second side plate in the second direction.

7. The drum cartridge according to claim 1, further comprising:

a second toner cartridge connector positioned at the inner surface of the first side plate, and a second harness being electrically connected to the second toner cartridge connector, the second harness positioned at the inner surface of the first side plate, and wherein the second harness is received between the protection wall and the inner surface of the first side plate.

8. The drum cartridge according to claim 7, further comprising a first cover covering at least a portion of the first harness and at least a portion of the second harness, and wherein the first harness and the second harness are received between the protection wall and the inner surface of the first side plate.

9. The drum cartridge according to claim 1, further comprising a drum-cartridge circuit board being electrically connected between the connector and the first connector.

10. The drum cartridge according to claim 9, wherein the first harness is electrically connected between the first connector and the drum-cartridge circuit board.

11. An image forming apparatus comprising:

the drum cartridge according to claim 1; and the main body, wherein the main body includes a controller and a casing, and wherein the first toner cartridge connector relays information stored in the first toner-cartridge memory of the first toner cartridge to the controller in a state where the drum cartridge is attached to the casing.

12. A drum cartridge comprising:

a first photosensitive drum rotatable about a first drum axis extending in a first direction;

a frame holding the first photosensitive drum and including:

a first side plate positioned at one side of the first photosensitive drum in the first direction;

a second side plate positioned at the other side of the first photosensitive drum in the first direction;

a first connecting plate connecting between one end of the first side plate in a second direction intersecting the first direction and one end of the second side plate in the second direction;

a second connecting plate connecting the other end of the first side plate in the second direction and the other end of the second side plate in the second direction, wherein the second connecting plate is spaced from the first connecting plate in the second direction;

a first toner cartridge connector positioned at an inner surface of the first side plate, a first harness being electrically connected to the first toner cartridge connector, the first harness positioned at the inner surface of the first side plate, the first harness extending in the second direction; and a protection wall extending in the second direction and positioned between the inner surface of the first side plate and the second side plate, wherein the first harness is received between the protection wall and the inner surface of the first side plate.

13. The drum cartridge according to claim 12, wherein the protection wall includes a first separator spaced apart from the inner surface of the first side plate and extending in a third direction intersecting the first direction and the second direction, the first separator positioned between the first harness and the second side plate in the first direction.

14. The drum cartridge according to claim 13, wherein the protection wall further includes a guide surface extending diagonally from the inner surface of the first side plate to a top end of the first separator.

15. The drum cartridge according to claim 12, wherein the first photosensitive drum is positioned between the first connecting plate and the second connecting plate in the second direction.

16. The drum cartridge according to claim 12, wherein in a state where a first toner cartridge is attached to the frame, the first toner cartridge is positioned between the first connecting plate and the second connecting plate in the second direction.

17. A drum cartridge comprising:

a first photosensitive drum rotatable about a first drum axis extending in a first direction;

a frame holding the first photosensitive drum and including:

a first side plate positioned at one side of the first photosensitive drum in the first direction;

a second side plate positioned at the other side of the first photosensitive drum in the first direction;

a first connecting plate connecting between one end of the first side plate in a second direction intersecting the first direction and one end of the second side plate in the second direction;

a main body connector positioned at an outer surface of the first connecting plate;

a first toner cartridge connector positioned at an inner surface of the first side plate, a first harness being electrically connected to the first toner cartridge connector, the first harness positioned at the inner surface of the first side plate, the first harness extending in the second direction; and a protection wall extending in the second direction and positioned between the inner surface of the first side plate and the second side plate, wherein the first harness is received between the protection wall and the inner surface of the first side plate.

18. The drum cartridge according to claim 17, wherein the first connecting plate includes one end and the other end in the first direction, wherein the one end of the first connecting plate is connected to the one end of the first side plate in the second direction, wherein the other end of the first connecting plate is connected to the one end of the second side plate in the second direction, and wherein the main body connector is positioned at an outer surface of the other end of the first connecting plate.

19. A drum cartridge comprising:

a first photosensitive drum rotatable about a first drum axis extending in a first direction;

a frame holding the first photosensitive drum and including:

a first side plate positioned at one side of the first photosensitive drum in the first direction, wherein the first side plate has a groove extending into the first side plate;

a second side plate positioned at the other side of the first photosensitive drum in the first direction;

a first toner cartridge connector positioned at an inner surface of the first side plate, a first harness being electrically connected to the first toner cartridge connector, the first harness positioned at the inner surface of the first side plate, the first harness extending in a second direction intersecting the first direction; and a protection wall extending in the second direction and positioned between the inner surface of the first side plate and the second side plate, wherein the first harness is received between the protection wall and the inner surface of the first side plate.

20. The drum cartridge according to claim 19, wherein the groove is recessed toward an outer surface of the first side plate from the inner surface of first side plate in the first direction.

21. The drum cartridge according to claim 19, wherein the protection wall includes a first separator extending in a third direction intersecting the first direction and the second direction, and wherein the first separator is positioned between the first harness and the second side plate in the first direction.

22. The drum cartridge according to claim 21, wherein the first separator extends from an edge of the groove in a third direction intersecting the first direction and the second direction.

23. The drum cartridge according to claim 21, wherein the first toner cartridge connector is positioned at one end of the first side plate in the third direction, wherein the first photosensitive drum is positioned at other end of the first side plate in the third direction, and wherein the first separator extends from the other end of the first side plate in the third direction toward the one end of the first side plate in the third direction.

24. The drum cartridge according to claim 21, wherein a length of the groove in the third direction is larger than a length of the first separator in the third direction.

25. The drum cartridge according to claim 21, wherein the first separator is positioned between a first toner cartridge and the first harness in the first direction, in a state where the first toner cartridge is attached to the frame.

26. The drum cartridge according to claim 21, wherein the protection wall has a guide surface for guiding the first toner cartridge during attachment of the first toner cartridge to the frame, the guide surface extending diagonally from the one end of the first side plate in the third direction toward the other end of the first side plate in the third direction so as to extend toward the second side plate, and wherein the first separator is positioned between the first photosensitive drum and the guide surface in the third direction.

27. A drum cartridge comprising:

a first photosensitive drum rotatable about a first drum axis extending in a first direction;

a frame holding the first photosensitive drum and including:

a first side plate positioned at one side of the first photosensitive drum in the first direction;

a second side plate positioned at the other side of the first photosensitive drum in the first direction;

a first toner cartridge connector positioned at an inner surface of the first side plate, a first harness being electrically connected to the first toner cartridge connector, the first harness positioned at the inner surface of the first side plate, the first harness extending in a second direction intersecting the first direction;

a protection wall extending in the second direction and positioned between the inner surface of the first side plate and the second side plate, wherein the first harness is received between the protection wall and the inner surface of the first side plate;

a second toner cartridge connector positioned at the inner surface of the first side plate;

a second harness being electrically connected to the second toner cartridge connector, the second harness positioned at the inner surface of the first side plate;

a first cover covering at least a portion of the first harness and at least a portion of the second harness;

a third toner cartridge connector positioned at the inner surface of the first side plate;

a fourth toner cartridge connector positioned at the inner surface of the first side plate;

a third harness being electrically connected to the third toner cartridge connector; and a fourth harness being electrically connected to the fourth toner cartridge connector, and wherein the first harness, the second harness, the third harness and the fourth harness are received between the protection wall and the inner surface of the first side plate.

28. The drum cartridge according to claim 27, further comprising a second cover covering at least a portion of the third harness and at least a portion of the fourth harness, and wherein the third harness and the fourth harness are received between the protection wall and the inner surface of the first side plate.

29. A drum cartridge comprising:

a first photosensitive drum rotatable about a first drum axis extending in a first direction;

a frame holding the first photosensitive drum and including:

a first side plate positioned at one side of the first photosensitive drum in the first direction;

a second side plate positioned at the other side of the first photosensitive drum in the first direction;

a first connecting plate connecting between one end of the first side plate in a second direction intersecting the first direction and one end of the second side plate in the second direction;

a second connecting plate connecting the other end of the first side plate in the second direction and the other end of the second side plate in the second direction, the second connecting plate spaced apart from the first connecting plate in the second direction;

a first toner cartridge connector positioned at an inner surface of the first side plate; and a first harness being electrically connected to the first toner cartridge connector, the first harness positioned at the inner surface of the first side plate, the first harness extending in the second direction, wherein the first side plate has a groove extending toward an outer surface of the first side plate from the inner surface of the first side plate in the first direction to define a harness placement space having therein the first harness, the harness placement space extending in the second direction; and a protection wall positioned at least partially within the groove and extending in a third direction intersecting the first direction and the second direction, the protection wall positioned between the first harness and the second side plate in the first direction.

30. The drum cartridge according to claim 29, wherein the protection wall includes a first separator in the groove extending in the third direction.

31. The drum cartridge according to claim 30, wherein the first separator extends from a top edge of the groove in the third direction.

32. The drum cartridge according to claim 30, wherein a length of the groove in the third direction is larger than a length of the first separator in the third direction.

33. The drum cartridge according to claim 30, further comprising a first toner cartridge attached to the frame, wherein the first separator is positioned between the first toner cartridge and the first harness in the first direction.

34. The drum cartridge according to claim 29, wherein the protection wall includes a guide surface for guiding a first toner cartridge during attachment of the first toner cartridge to the frame, the guide surface extending diagonally from the one end of the first side plate in the third direction toward the other end of the first side plate in the third direction so as to extend toward the second side plate.

35. The drum cartridge according to claim 34, wherein the protection wall includes a first separator extending into the groove from a bottom end of the guide surface in the third direction, the first separator being between the harness and the second side plate.

* * * * *